US008627588B2

(12) United States Patent
Rosander et al.

(10) Patent No.: US 8,627,588 B2
(45) Date of Patent: Jan. 14, 2014

(54) ESL LOCKING MECHANISM

(76) Inventors: Pär Rosander, Uppsala (SE); Håkan Sjödin, Knivsta (SE); Nils Hulth, Uppsala (SE); Daniel Ekfjorden, Göteborg (SE); Elias Svensson, Göteborg (SE); Kenneth Ellingsen, Fyllingsdalen (NO); Torsten Frey-Hall, Göteborg (SE); Eirik Lundmark, Oslo (NO); Anders Nilsson, Vara (SE); Maral Babapour, Göteborg (SE); Ines Junge, Berlin (DE)

( * ) Notice: Subject to any disclaimer, the term of this patent is extended or adjusted under 35 U.S.C. 154(b) by 267 days.

(21) Appl. No.: 13/257,460

(22) PCT Filed: Mar. 9, 2010

(86) PCT No.: PCT/SE2010/050258

§ 371 (c)(1),
(2), (4) Date: Sep. 19, 2011

(87) PCT Pub. No.: WO2010/107366

PCT Pub. Date: Sep. 23, 2010

(65) Prior Publication Data

US 2012/0023797 A1 Feb. 2, 2012

(30) Foreign Application Priority Data

Mar. 20, 2009 (SE) ..... 0950177

(51) Int. Cl.
*G09F 3/18* (2006.01)

(52) U.S. Cl.
USPC ..... 40/655; 40/661.01; 40/661.03; 340/5.91

(58) Field of Classification Search
USPC ..... 40/655, 661.01, 661.03, 642.02; 340/5.91
See application file for complete search history.

(56) References Cited

U.S. PATENT DOCUMENTS 5,473,832 A * 12/1995 Briechle et al. ..... 40/124.05
5,553,412 A * 9/1996 Briechle et al. ..... 40/124.01

(Continued)

FOREIGN PATENT DOCUMENTS

GB 2 249 854 A 5/1992

OTHER PUBLICATIONS

International Search Report for International Application No. PCT/SE2010/050258 mailed Jun. 15, 2010.

(Continued)

*Primary Examiner* — Gary Hoge
(74) *Attorney, Agent, or Firm* — Jones Day

(57) ABSTRACT

An ESL and ESL holder combination includes a locking mechanism for releasably securing the ESL to the ESL holder, and an ESL provided with at least one gripping means for cooperative engagement with the ESL holder. The ESL holder is attachable to an edge of a shelf, the ESL holder being provided with one or more receiving means such as for example slots for receiving the gripping means and the locking element in cooperative engagement. A spring loaded element is arranged inside the ESL such that the spring loaded element, in a latched position, secures the ESL to the ESL holder when the gripping means is brought into a hooked position in the receiving means. When displaced from its latched position, allowing the gripping means to leave its hooked position, this enables removal of the ESL from the ESL holder.

16 Claims, 11 Drawing Sheets

(56) References Cited

U.S. PATENT DOCUMENTS

| | | | | |
|---|---|---|---|---|
| 5,775,017 | A * | 7/1998 | Morrow | 40/642.01 |
| 6,069,596 | A * | 5/2000 | Marvin et al. | 345/52 |
| 6,189,248 | B1 * | 2/2001 | Nagel et al. | 40/661.03 |
| 6,698,701 | B1 * | 3/2004 | Dalton | 248/222.12 |
| 7,287,350 | B2 * | 10/2007 | Fast et al. | 40/642.02 |
| 7,900,387 | B2 * | 3/2011 | Lee et al. | 40/661.03 |
| 2003/0111580 | A1 * | 6/2003 | Catteau et al. | 248/222.51 |
| 2004/0262470 | A1 * | 12/2004 | Lowry et al. | 248/205.1 |
| 2009/0178314 | A1 * | 7/2009 | Nguyen | 40/446 |
| 2010/0031548 | A1 * | 2/2010 | Lee et al. | 40/655 |

OTHER PUBLICATIONS

Written Opinion of the International Searching Authority for International Application No. PCT/SE2010/050258 completed on Jun. 14, 2010.

* cited by examiner

Figure 1b
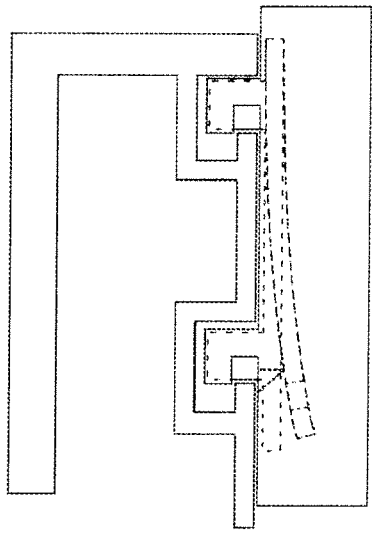
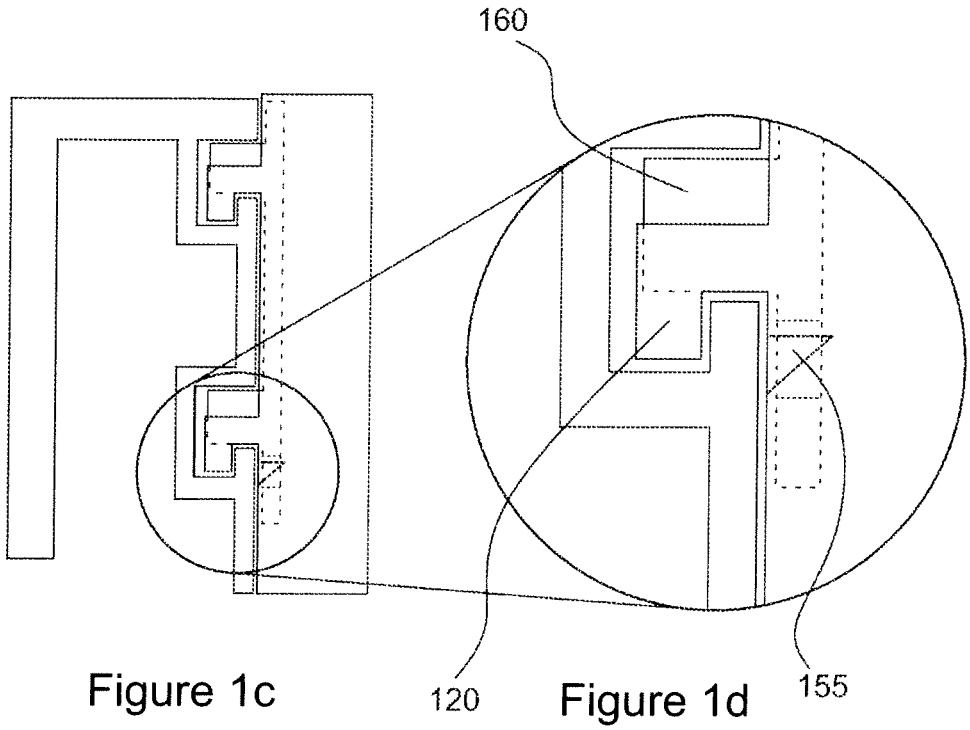
Figure 1c
Figure 1d
Figure 1

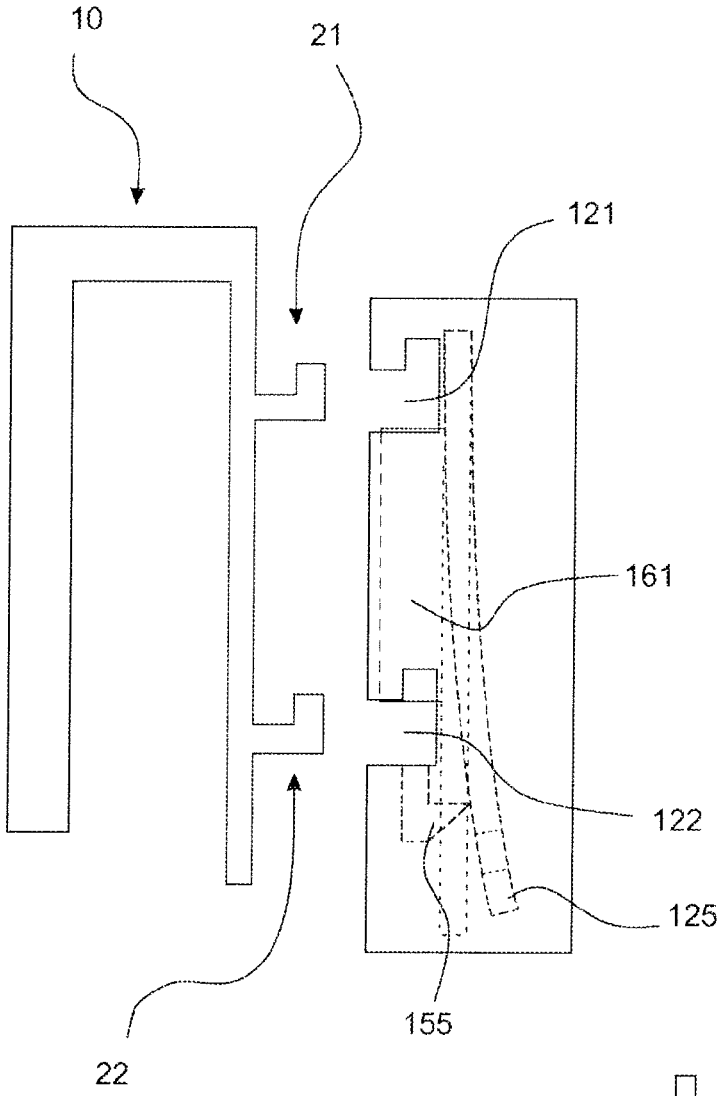
Figure 1e
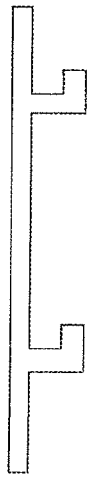
Figure 1f
Figure 1

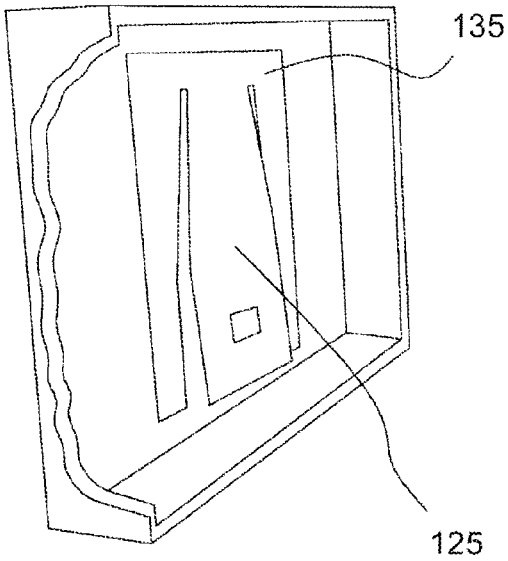
Figure 2a
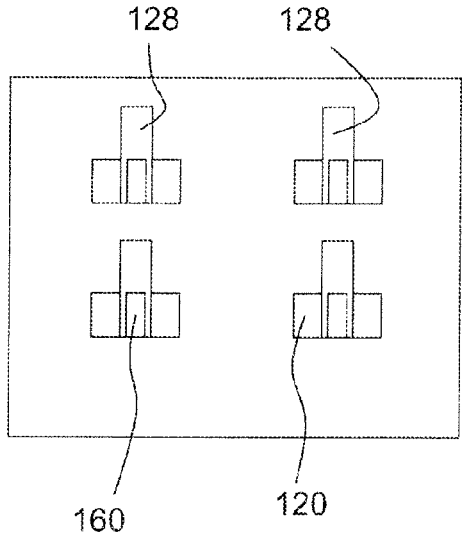
Figure 2b
Figure 2
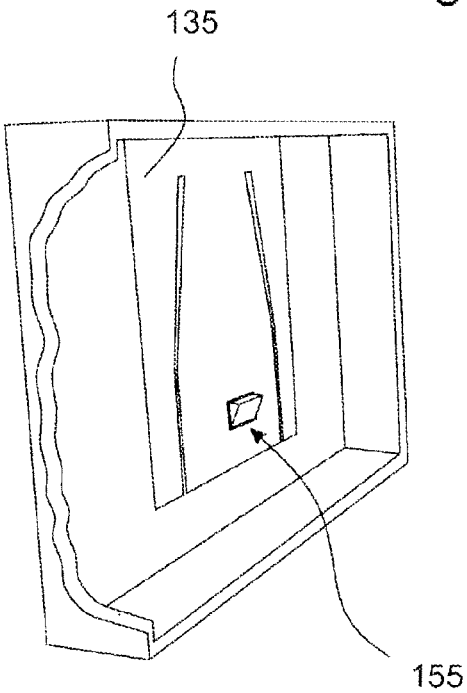
Figure 3a
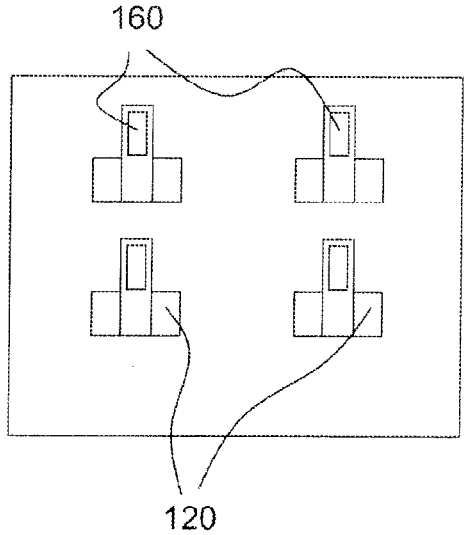
Figure 3b
Figure 3

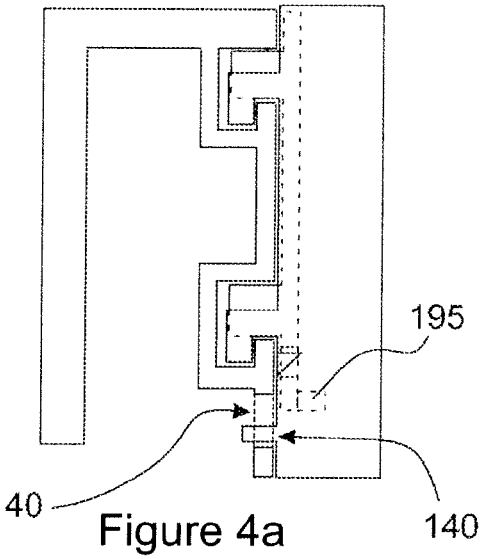
Figure 4a
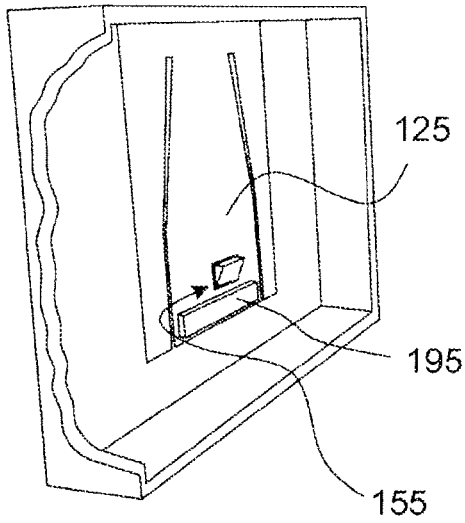
Figure 4b
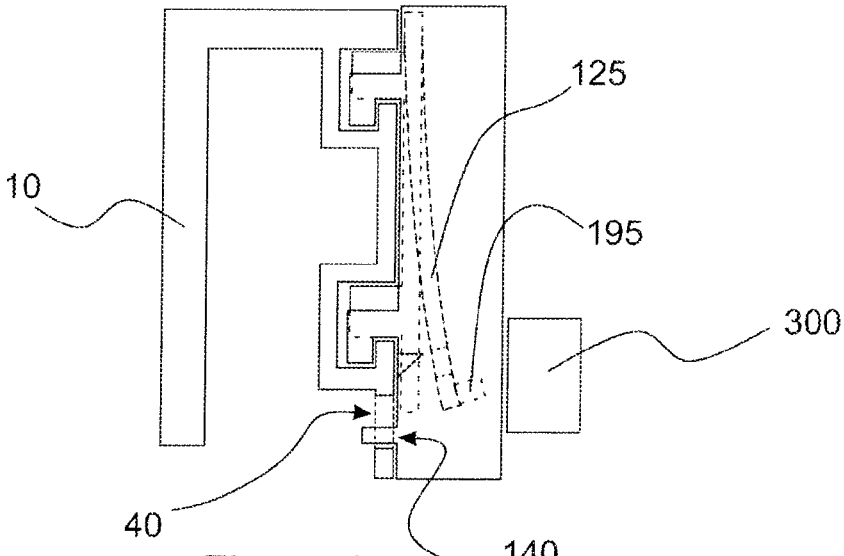
Figure 4c
Figure 4

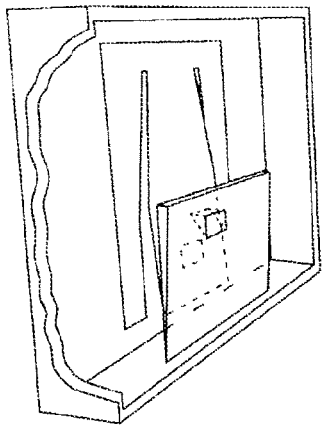
Figure 5a
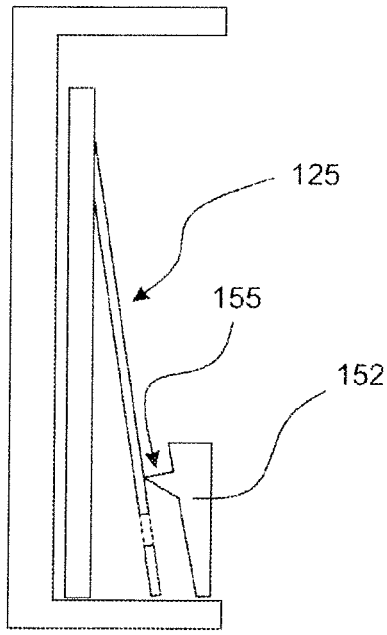
Figure 5b
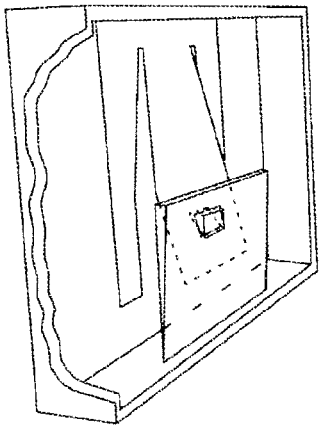
Figure 5c
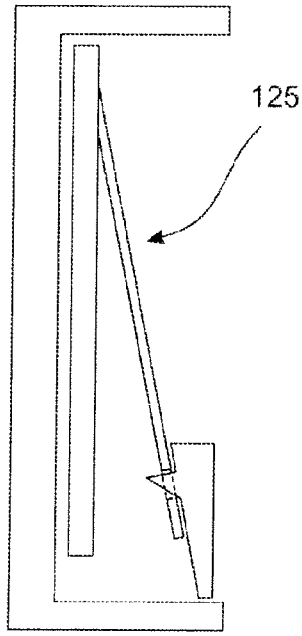
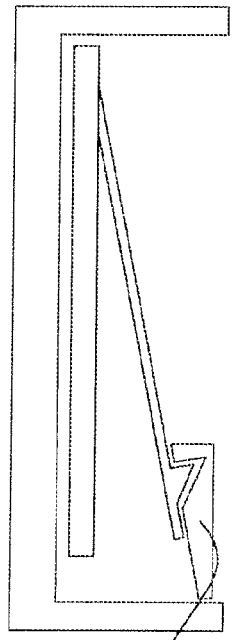
Figure 5
Figure 5d
Figure 5e Figure 6a
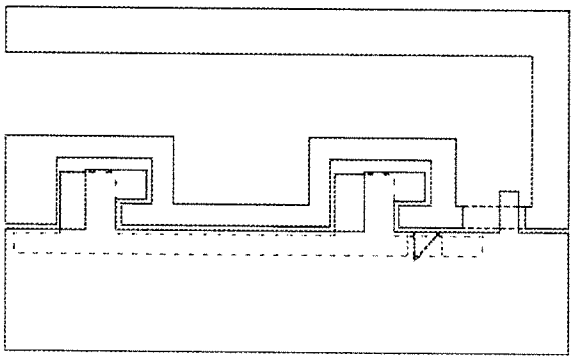
Figure 6b
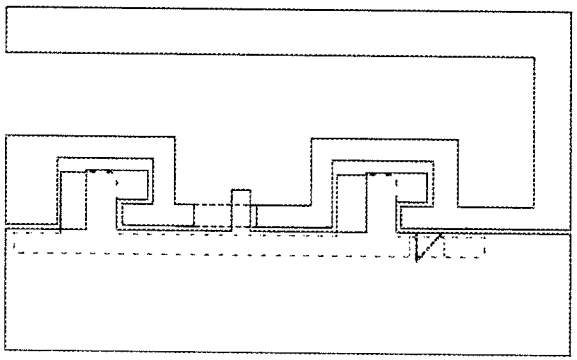
Figure 6

Figure 7a
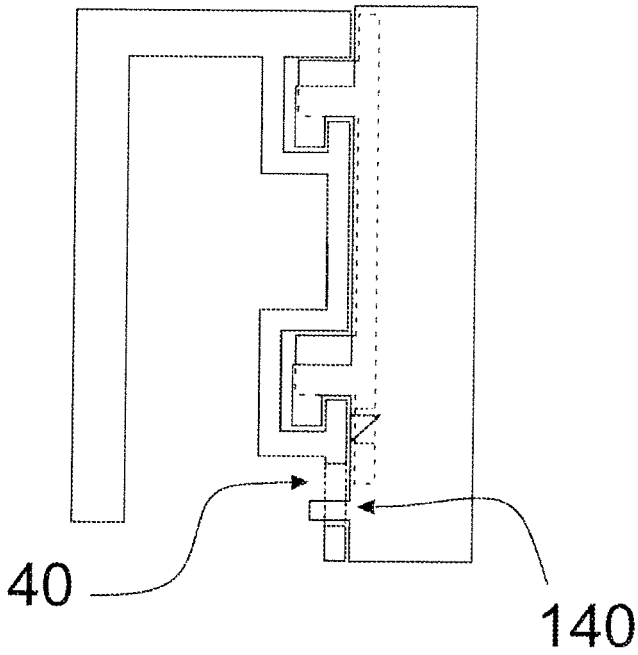
Figure 7b
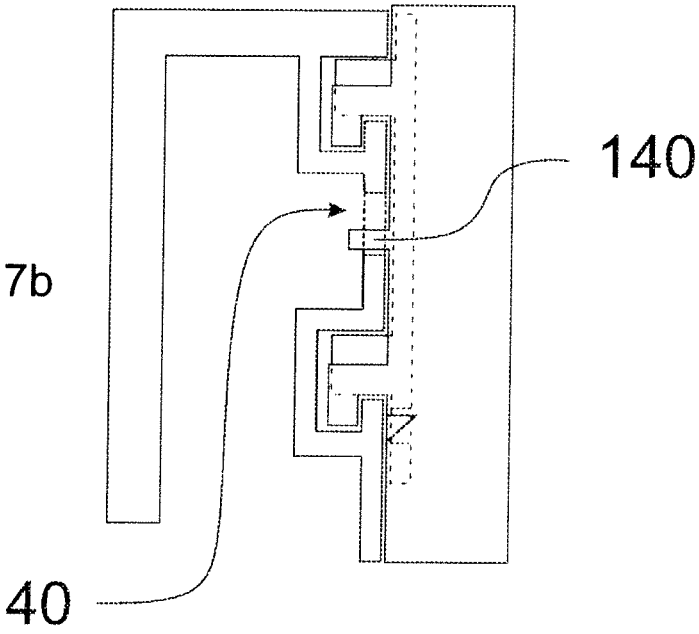
Figure 7

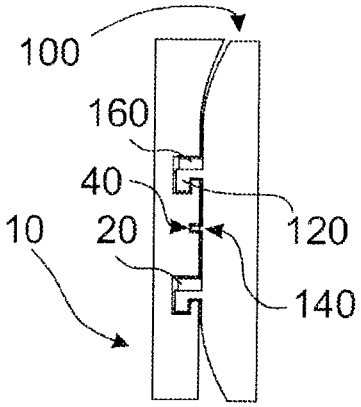
Figure 8a
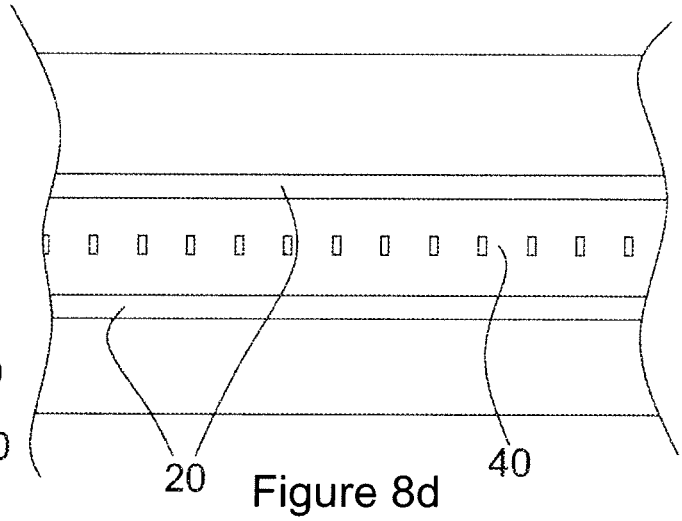
Figure 8d
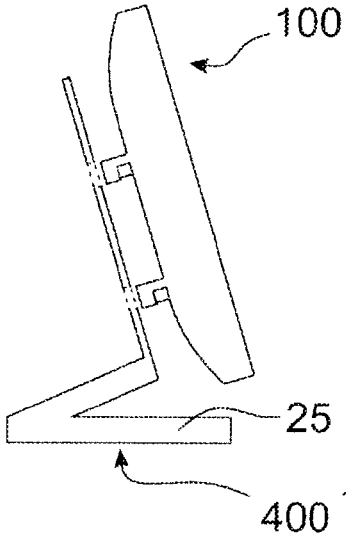
Figure 8b
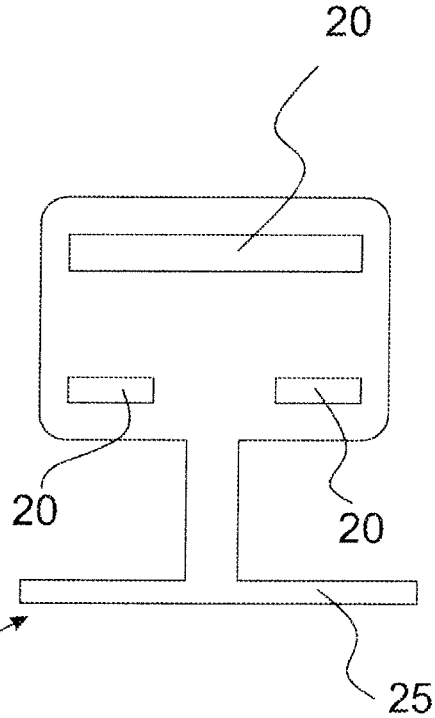
Figure 8c
Figure 8

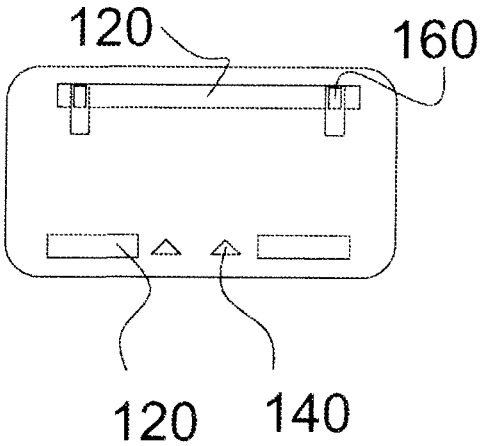
Figure 9a
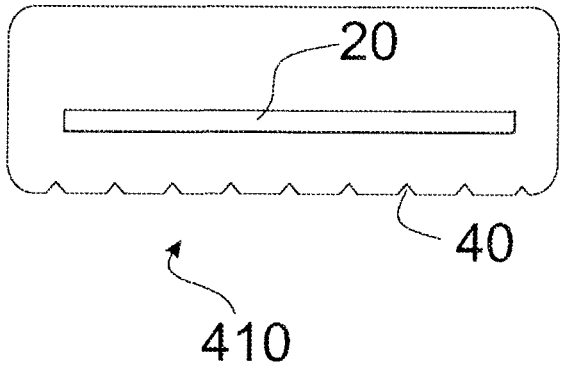
Figure 9b
Figure 9
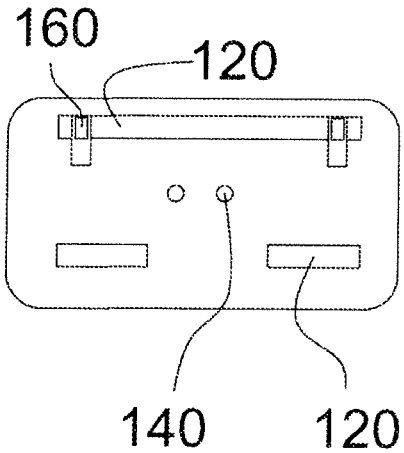
Figure 10a
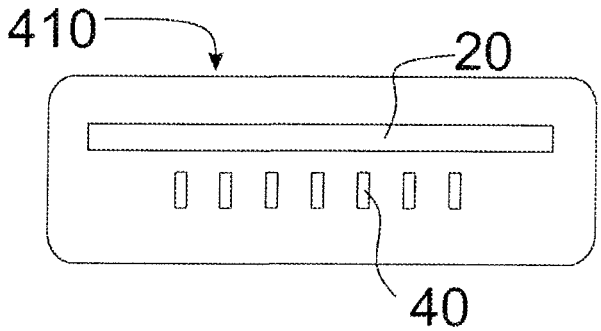
Figure 10b
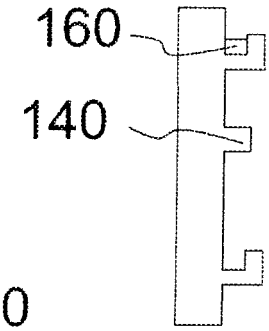
Figure 10c
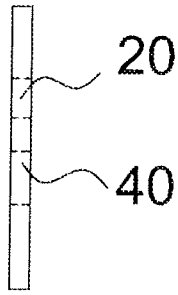
Figure 10d
Figure 10

ESL LOCKING MECHANISM

CROSS REFERENCE TO RELATED APPLICATIONS

This application is a national stage application of International Application No. PCT/SE2010/050258, filed on Mar. 9, 2010, which claims the benefit of Swedish Patent Application No. 0950177-6, filed on Mar. 20, 2009, the entire contents of both applications are incorporated herein by reference.

TECHNICAL FIELD OF THE INVENTION

The embodiments of the present invention relate to an electronic shelf label (ESL) and shelf edge rail combination. In particular, the embodiments of the present invention relate to such a combination comprising a locking mechanism for locking the ESL to the shelf rail edge.

BACKGROUND OF THE INVENTION

Electronic labeling systems are used all over the world, in particular in large facilities, for displaying information like price and the like for services and items available for customers.

Some known electronic labeling systems comprise an Electronic Shelf Label (ESL) and a shelf edge rail. The shelf edge rail is often permanently mounted onto the shelf, and then the ESL is attached to the shelf edge rail. A problem with most systems available today is that the ESL can be easily removed from the shelf edge rail by anyone, whereas it is desired that the ESL is easy to remove from the shelf edge rail only by a person authorized to do so to avoid the loss of ESLs by theft or vandalism.

SUMMARY OF THE INVENTION

The object of the embodiments of the present invention is to overcome at least some of the drawbacks of the prior art. This object is achieved, for example, by a combination as defined in claim 1.

According to the embodiments of the present invention an ESL and ESL holder combination comprises a locking mechanism for releasably securing the ESL to the ESL holder, and an ESL provided with at least one gripping means for cooperative engagement with the ESL holder.

The embodiments of the present invention are intended to overcome problems related to loss of ESLs due to theft or vandalism.

It is another object of the embodiments of the present invention to provide an ESL which is securely attached to the shelf edge rail, while being very easy to remove provided that a specific and correct tool is used.

It is another object of the embodiments of the present invention to enable locking of the ESL to a specific position on the shelf edge rail, and avoid the ESL being slid sideways to a new position by someone not authorized to do so.

It is yet another object of the embodiments of the present invention to provide a shelf edge rail that does not collect dust and other unwanted particles in the receiving section on the parts of the shelf rail edge that are not in use, i.e., occupied by ESL units.

Embodiments of the present invention are defined in the claims. Other objects, advantages and novel features of the invention will become apparent from the following detailed description of examples of embodiments of the present invention when considered in conjunction with the accompanying drawings and claims.

BRIEF DESCRIPTION OF THE DRAWINGS

Preferred embodiments of the present invention will now be described with reference to the accompanying drawings, wherein:

FIG. 1*b* illustrates the ESL when a gripping element is inserted into a mating recess on the shelf edge rail, and brought to an inner position;

FIG. 1*c* illustrates the ESL when the gripping means is in a hooked position and a spring loaded element is in a latched position;

FIG. 1*d* illustrates a close-up view of the gripping means in a hooked position, the locking element in a locked position, and the spring loaded element in a latched position;

FIG. 1*e* illustrates an ESL with a large locking element and a substantially flat backside surface;

FIG. 1*f* illustrates an ESL holder with a substantially flat backside surface;

FIGS. 2*a* and 2*b* illustrate the ESL in an un-locked position;

FIGS. 3*a* and 3*b* illustrate the ESL in a locked position;

FIGS. 4*a*-4*b* illustrate an ESL comprising a magnetic element in a locked position;

FIG. 4*c* illustrates the ESL as it enters its unlocked position in the presence of a magnetic field;

FIGS. 5*a*-5*b* illustrate embodiments of the present invention wherein the spring loaded element has an induced tension in an unlocked state;

FIGS. 5*c*-5*e* illustrate embodiments of the present invention wherein the spring loaded element has an induced tension in a locked state;

FIGS. 6*a*-6*b* illustrate an embodiment of the present invention with gripping means adapted to attach to an "easy to keep clean" rail, and the positioning element in two different positions;

FIGS. 7*a*-7*b* illustrate embodiments of the ESL with a positioning element at different positions;

FIG. 8*a* illustrates an ESL locked to an ESL holder;

FIG. 8*b* illustrates a side view of one example of a free-standing ESL holder;

FIG. 8*c* illustrates a front view of the free-standing ESL holder;

FIG. 8*d* illustrates a longitudinally extending shelf edge rail;

FIG. 9*a* illustrates an ESL adapted for a plate-like ESL holder;

FIG. 9*b* illustrates a plate-like ESL holder;

FIG. 10*a* illustrates an ESL adapted for a plate-like ESL holder;

FIG. 10*b* illustrates a plate-like ESL holder;

FIG. 10*c* shows a side view of a simple ESL; and

FIG. 10*d* shows a side view of a simple plate-like ESL holder.

DETAILED DESCRIPTION OF EMBODIMENTS OF THE PRESENT INVENTION

For the purpose of the present invention, the term electronic shelf label (ESL) 100 means an electronic label with a display used to display price, information, or promotional messages, and also dynamically update or change the message. The label is typically used on shelf edges, peg hooks, bins, hangers, and other places in retail stores.

Figures 1, 1A:
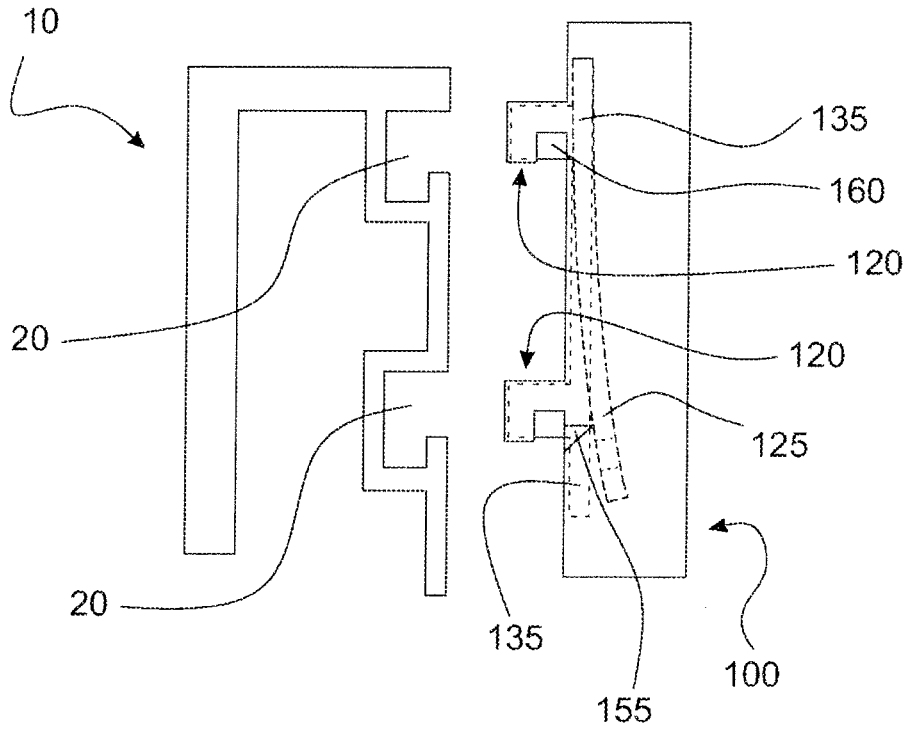
FIG. 1*a* illustrates an ESL and a shelf edge rail separated from each other.

In an embodiment of the present invention illustrated in FIG. 1*a*, an ESL 100 and ESL holder 10 combination comprises a locking mechanism for releasably securing the ESL 100 to the ESL holder 10. The ESL holder 10 is a rail in the shown embodiment, where the rail is attachable to a shelf edge. The rail comprises at least one recess, but in the shown embodiment two recesses, having a generally "L"-shaped cross-section. The mechanism further comprises a number of components, namely at least one gripping means 120 on the ESL having a substantially hook-shaped cross-section. The gripping means extends outwards from the back of the ESL. The at least one gripping means 120 is adapted for cooperative engagement with the ESL holder 10.

The mechanism also comprises a movable locking plate 135, which is arranged inside the ESL 100 so as to be slidable along an inner wall of the ESL housing. The movable locking plate 135 is suitably made of metal, but any material that can provide some degree of resiliency is possible. The movable locking plate has at least one locking element 160, which in the shown embodiment is an element protruding substantially perpendicularly from the movable locking plate 135. The locking element(s) 160 extend out from the interior of the ESL 100 through suitable slits in the housing at a position adjacent to the gripping means. The slits have a size that is larger than the extension of the locking elements for reasons that become clear below. The movable locking plate 135 is also provided with a spring loaded element 125. In the shown embodiment of the present invention, the spring loaded element 125 is provided by cutting slits in the movable locking plate 135 to form a "tongue" that can be bent to provide a spring action. The tongue has a slot provided at its free end. This slot can receive a latch element 155 which, in the shown embodiment, comprises a protruding wedge-shaped element. In the position shown in FIG. 1*b*, the locking element 160 is resting on an edge on the receiving means 20 with the gripping means 120 in an inserted position. Thus, the spring loaded element 125 is in its unlatched position in the ESL 100 in which the latch 155 and the slot do not mate.

The locking element 160 is attached to a movable locking plate 135 on the ESL 100 for cooperative engagement with the ESL holder 10. Additionally, as mentioned above, the ESL holder 10 is provided with one or more recesses that function as receiving means 20 for receiving the gripping means 120 and the locking element 160 in cooperative engagement. The locking element 160 may be arranged adjacent to the gripping means 120 and positioned on the ESL 100 such that the locking element 160 is insertable into the receiving means 20 (recesses) on the ESL holder 10 (rail) together with the gripping means 120. In the initial position, i.e., when the gripping means 120 and locking element have been inserted, the tongue is still in a non-engaged state with respect to the latch member, as illustrated in FIG. 1*b*. Thereafter, the gripping means on the ESL 100 is displaceable downwards so as to bring the gripping means 120 into a hooked position in the recess in the ESL holder 10 (see FIG. 1*c*). In this process, the movable locking plate 135 will slide inside the ESL 100 because the locking elements 160 rest on the edge of the recess in the rail. The locking element 160 thus remains in a resting position with respect to the rail, which causes the movable locking plate 135 to move inside the ESL 100 relative to the ESL housing when the ESL 100 is pushed to a locked position on the ESL holder 10 and the gripping means 120 is brought into a hooked position in the receiving means 20, as shown in FIGS. 1*c*-1*d*. This relative movement of the plate with respect to the ESL 100 causes the slot in the tongue to become positioned over the latch and thereby snaps onto it. Thereby the spring loaded element 125 (the tongue) on the movable locking plate 135 secures the locking element 160 in its locked position by grasping the latch 155 and entering the latched position shown in detail in FIG. 1*d*. Thus, the locking element 160 prevents removal of the ESL 100 from the ESL holder 10 until the spring loaded element 125 on the movable locking plate 135 is forced against the spring force to leave its latched position. This allows the locking element 160 to enter its unlocked position as the gripping means 120 leaves its hooked position, which enables removal of the ESL 100 from the ESL holder 10. In addition, FIG. le illustrates an embodiment of the present invention where the gripping means 121, 122 on the ESL 100 is arranged as two recesses (a first gripping means 121 and a second gripping means 122), the receiving means is arranged as two protruding elements (a first receiving means 21 and a second receiving means 22), and the locking element 161 extends between the first 121 and the second 122 gripping means. When the gripping means 121, 122 on the ESL 100 mates with the receiving means 21, 22 on the ESL holder 10, and the gripping means 121, 122 is brought to a hooked position, the ESL 100 is moved downwards such that the locking element 161 that rests on the edge of the first receiving means 22 will secure the first gripping means 121 in a locked position as the spring loaded element 125 snaps into position and enters the latched position. In this way, the locking mechanism can be placed in an unlocked position and a locked position, respectively. The ESL 100 in this embodiment of the present invention, with a substantially flat surface, is also suitable for applications where the ESL 100 needs to be attached to a substantially flat surface using fastening means (for example, glue) to adhere the ESL 100 to, for example, a wall or a cardboard box. FIG. 1*f* illustrates an ESL holder 10, 400, 410 having a substantially flat backside surface. Thus, this ESL holder 10, 400, 410 can be directly attached to a wall, container, cardboard box, or any other surface onto which it can be attached using fastening means similar to, for example, glue.

The ESL holder 10 can be a shelf edge rail 10, a free-standing holder 400, a plate holder 410, or any other holder adapted to receive an ESL 100 according to the embodiments of the present invention. An ESL holder 10, 400, 410 is defined as any object on which a receiving means 20 has been arranged to receive the gripping means 120 of an ESL 100.

The locking mechanism can be mounted onto the ESL 100 or integrated in the ESL 100. In addition, parts of the locking mechanism may be integrated in the ESL 100, and other parts may be assembled onto/in the locking mechanism.

Figures 3, 3C:
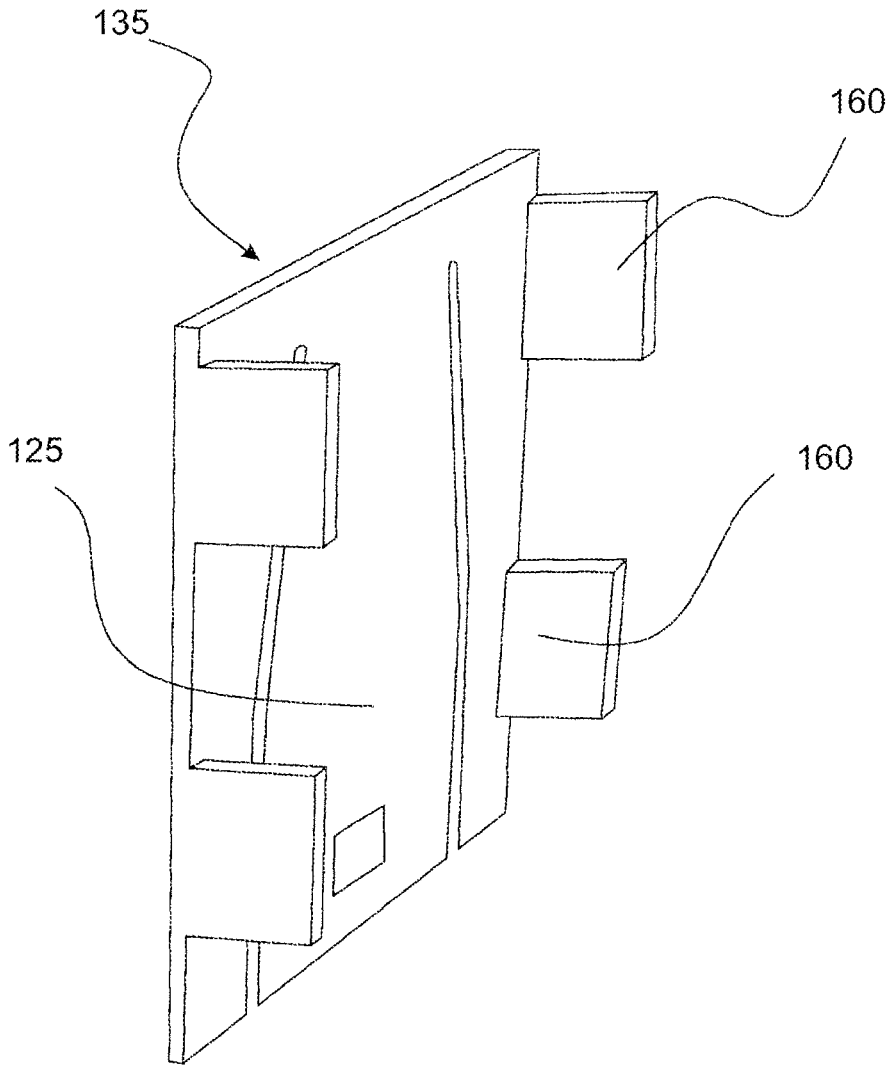
FIG. 3*c* illustrates an example of the movable locking plate.

Referring to FIG. 2, the ESL 100 is illustrated with the locking element in an unlocked position and the spring loaded element 125 in an unlatched position from the interior and the backside of the ESL 100 respectively. FIGS. 3*a* and 3*b* illustrate the locking element in a locked position and the spring loaded element 125 in a latched position from the interior and the backside of the ESL 100 respectively. When the movable locking plate 135 is moved from its position in FIG. 2 to its position in FIG. 3, the spring loaded element 125 moves from its unlatched position and snaps into its latched position when the edge of the recess or hole in the spring loaded element 125 slides over the edge of the latch 155. FIG. 2*b* and FIG. 3*b* also illustrate how the locking elements 160, attached to the movable locking plate 135, are moved from an unlocked position to be secured at a locked position as the spring loaded element 125 enters the latched position. In addition, FIG. 3*c* illustrates the movable locking plate 135 with its, in this example, four locking elements 160. When the movable locking plate 135 is mounted in position in the ESL 100, the locking elements 160 shoot out through slots 128 in the ESL 100 as can be seen in the close-up view of FIG. 1*d*, adjacent to the gripping means 120. However, locking elements 160 can be positioned elsewhere, that is, separated from the gripping means 120, without leaving the scope of the embodiments of the present invention.

When the gripping means 120 has reached an end position in the receiving means 20, and is brought into a hooked position in the receiving means 20 by sliding it down into the recess (or up as in the embodiment shown in FIGS. 6*a*-6*b*), the spring loaded element 125 grasps the latch by spring action as it enters a latched position and secures the locking element in a locked position. Thereby, the spring loaded element 125 prevents removal of the ESL 100 from the shelf rail edge 10 unless the spring loaded element 125 is forced from the latched position, which thereby allows for the locking element 160 to leave its locked position as the gripping means 120 leaves its hooked position, enabling removal of the ESL 100 from the shelf rail edge 10.

The gripping means 120 provided on the ESL 100 for cooperative engagement with the receiving means 20 on the shelf edge rail 10 is preferably substantially hook-shaped for grasping the receiving means 20 on the shelf edge rail 10. The gripping means 120 may have an "L"-shape, a more rounded hook-shape, or any other hook-like shape suitable for securely grasping a receiving means 20. The locking member 160 arranged on the ESL 100 will, together with the gripping means 120, interact with the receiving means 20 on the shelf edge rail 10 while the gripping means 120, due to its hook-shaped cross-section, can be adapted to hook onto the receiving means 20 on the shelf edge rail 10.

The gripping means 120 on the ESL 100 may be extended along the entire backside of the ESL 100 forming a ledge or rim like structure, or it may cover only one section or a plurality of sections. The hook-shaped gripping means 120 may be arranged to hook onto the receiving means 20 such that the gripping means 120 mates with the receiving means 20.

In a preferred embodiment of the present invention, the ESL 100, in addition to the locking mechanism, also comprises a positioning element 140 illustrated in FIG. 4*a* (also present in FIGS. 4*c*, 6*a*-6*b*, 7*a*-7*b*, 8*a*, 9*a* and 10*a*). The positioning element 140 can be arranged anywhere on an ESL 100 surface such that during attachment to an ESL holder 10, 400, 410 it abuts the ESL holder 10, 400, 410, wherein a mating surface of the ESL holder 10, 400, 410 comprises a positioning element slot 40. The positioning element 140 secures the ESL 100 sideways with respect to the ESL holder 10, 400, 410, thereby forcing the ESL 100 into a fixed position onto the ESL holder 10, 400, 410. The positioning element 140 can be a pin that is placed somewhere on the mating surface of the ESL 100. The positioning element slot 40 is placed somewhere on the mating surface of the ESL holder 10, 400, 410. The positioning element 140 and the positioning element slot 40 are arranged at their respective mating surface such that they mate when the ESL 100 is assembled onto the ESL holder 10, 400, 410, and different positions of the positioning element 140 and the positioning element slot 40 are illustrated in FIGS. 6-10. It is also possible to place the positioning element 140 on the ESL holder 10, 400, 410, and the positioning element slot 40 somewhere in the mating surface of the ESL 100, as long as the positioning element 140 and the positioning element slot 40 are adapted to mate when mounting the ESL 100 to the ESL holder 10, 400, 410. The locking element 160 and the positioning element 140 may also be the same element.

Magnetic means may also be provided on the spring loaded element 125, as illustrated in FIG. 4, in order to enable attracting the spring loaded element 125. The spring loaded element 125 can, with a proper choice of material and dimension, exhibit enough magnetic force for it to be attracted by an external magnet, and the effect may be amplified. Namely if, according to the embodiments of the present invention, the locking mechanism comprises a magnetic element 195 which is attached to the spring loaded element 125, the magnetic element 195 may be a ferromagnetic element. The magnetic element 195 is mounted onto the spring loaded element 125 such that it can be affected by an external magnet 300. By letting the magnetic field from the external magnet 300 act on the magnetic element 195 in the locking mechanism, the spring loaded element 125 is moved from its latched position to its unlatched position, thereby enabling releasing the ESL 100 from the shelf edge rail 10, as illustrated in FIG. 4*c* where the magnet 300 attracts the magnetic element 195 on the spring loaded member 125. In the embodiments illustrated in FIGS. 1-4, the spring loaded element 125 is moved from a latched position to an unlatched position when the spring loaded element 125 is moved, for example, in the presence of a magnetic field, in a direction from the shelf edge rail-side and towards a front side of the ESL 100. It is also possible, as illustrated in FIG. 5, to induce tension in the spring loaded element 125 such that it is at rest in its latched position shown in FIGS. 5*c* and 5*d* when extended from the movable locking plate with the latch 155 mounted to or integrated in a latch mount element 152. Thus, to enable unlocking of the ESL 100 and move the spring loaded element 125 from the latched position to its unlatched position, the spring loaded element 125 is, for example by the force of a magnetic field, moved in a direction towards the shelf edge rail-side of the ESL 100. It is also possible, as illustrated in FIG. 5*e*, to provide the spring loaded element 125 with a latch 155, and provide the ESL housing or a separate element 127 with a hole or a recess adapted to receive and secure the latch 155 in its latched state.

Normally, the external magnet 300 and the magnetic element 195 have a north and a south pole, and different poles attract each other whereas like poles repel each other. Thus, as the external magnet is placed adjacent to the ESL 100 as shown in FIG. 4*c*, the external magnet attracts the magnetic element 195 attached to the spring loaded element 125, and retracts the spring loaded element 125 from the recess by magnetic forces. In this embodiment, the spring loaded element 125 is positioned in an unlatched position when attracted by a magnetic field from an external magnet. It is also possible to use the repelling force of the magnet as a mechanism to unlatch the spring loaded element 125 by placing a magnetic element comprising a north and a south pole onto the locking member, and orienting it such that the repelling force from the external magnet 300 repels the spring loaded element 125 from its latched position to an unlatched position. This allows for the locking element 160 to leave its locked position and enter its unlocked position, thus allowing the gripping means 120 to exit its hooked position and subsequently remove the ESL 100 from the ESL holder 10, 400, 410.

It is also within the scope of the embodiments of the present invention to provide a mechanical solution to move the spring loaded element 125 from a latched position to an unlatched position. This can be done in many ways. One way is to arrange a hole in the ESL 100 that is adapted to receive a key or a tool, and by rotation, or through pressure from outside ESL 100, move the spring loaded element 125 from its latched position to its unlatched position.

In an embodiment of the present invention, the shelf edge rail 10 comprises at least one receiving element 20 adapted to receive the protruding element of the locking mechanism and/or the ESL 100. In the following discussion, ESL 100 may be just the ESL 100 or the ESL 100 including the locking mechanism. The receiving means 20 may be a recess adapted to receive the protruding element of the ESL 100. The recess may, in a cross-sectional view, be "L"-shaped, have a rounded hook-shape, or any other hook-like shape suitable for securely holding the gripping means 120 of the ESL 100. The receiving means 20 on the shelf edge rail 10 may also be a protruding hook-like element adapted to receive the protruding element of the ESL 100. The receiving means 20 may also be a combination of at least one recess and at least one protruding element.

In another embodiment of the present invention illustrated in FIGS. 6*a*-6*b*, the gripping means 120 of the ESL 100 is hook-like with the hook pointing upwards, and the receiving means 20 on the shelf edge rail 10, which is adapted to receive the gripping means 120, is shaped to be able to hold the ESL 100. In this embodiment, dust and other dust-like particles do not get trapped inside the gripping means 120. In addition, the gripping means 120 is easy to clean, and dust may even fall out of the gripping means 120 by gravitational forces. It is also illustrated in FIGS. 6*a*-6*b* how the positioning element may be positioned at different positions on the ESL 100. Furthermore, it is essential that the position of the positioning element 140, further exemplified in FIGS. 7*a*-7*b*, is adapted to mate with the positioning element slot 40.

In an embodiment of the present invention, the at least one recess is an elongated recess extending in the longitudinal direction of the shelf edge rail 10, having a generally "L"-shaped cross-section. The leg of the "L" extends substantially perpendicular to the surface of the shelf edge rail 10, and the foot of the "L" extends substantially perpendicular to the leg inside the shelf edge rail 10. The length and width of the leg and the foot of the "L" in the ESL 100 and the shelf rail edge 10 can be varied as long as the gripping means 120 of the ESL 100 is adapted to match the receiving means 20 of the shelf edge rail 10.

In an embodiment of the present invention, illustrated in FIGS. 8*a* and 8*d*, the shelf edge rail 10 comprises at least two recesses adapted to receive the ESL 100. The recesses have an "L"-shaped cross-section, and are adapted to receive the hook-like gripping means 120 on the ESL 100. The locking element 160 is arranged adjacent to the gripping means 120 on the ESL 100. As the ESL 100 is moved downwards so as to bring the gripping means into a hooked position in the recess in the ESL holder 10, the locking element 160 is moved from its unlocked position to its locked position in each recess of the shelf edge rail 10 upon locking. In this embodiment, there is a locking member adjacent to every gripping means of the ESL 100, but it is also possible to reduce the number of locking members down to at least one.

In another embodiment of the present invention, the shelf edge rail 10 is subdivided in sections, and thus the receiving means 20 is not continuous along the shelf edge rail 10. Each section of the shelf edge rail 10 may be adapted to comprise one or a plurality of ESLs.

In another embodiment of the present invention, the ESL holder 400 is a free-standing holder 400 illustrated in FIGS. 8*b* and 8*c*. The free-standing holder 400 comprises an ESL attachment surface with receiving means 20, where the attachment surface is mounted to at least one foot 25 which supports the free-standing holder 400 and makes it self-supported on a substantially flat surface. The free-standing holder 400 may also be placed on sloped surfaces (for example if glued), such that it is secured in a fixed position. The foot 25 may also function as a wall-mount if angled differently with respect to the part of the free-standing holder 400 where the ESL 100 is attached. The free-standing holder can be made of a plastic material, a composite, or a metal, although it is not restricted to those materials.

Referring to FIG. 8*d*, there is no specified length of the shelf rail edge 10. The shelf rail edge 10 can be longitudinally extending and adapted to fit onto a shelf edge of any length. The ends of the shelf rail edge 10 may be open, or closed. The longitudinally extending shelf rail edge may also comprise positioning element slots 40 adapted to receive positioning elements 140 of the ESL 100. The positioning element 140 secures the ESL 100 to a specific position on the shelf edge rail 10 and prevents the ESL 100 from being slid sideways.

In yet another embodiment of the present invention, as shown in FIGS. 9*a*-9*b* and 10*a*-10*d*, the ESL holder 410 includes a plate-like holder 410 comprising at least one recess adapted to receive the gripping means 120 and the locking element 160 of the ESL 100. The plate-like holder 410 can be made of plastic, composite, a metallic material, or the like. The plate-like holder 410 may comprise slots 40 for receiving a positioning element 140 of the ESL 100 and securing the ESL 100 at a substantially fixed position. The plate-like holder 410 can be placed onto a shelf edge rail 10, or it may be attached directly to a shelf edge or the like. It is to be understood by a person skilled in the art that the plate-like holder 410 is very flexible, and may be used in a wide range of labeling applications without leaving the scope of the embodiments of the present invention. The receiving means 20 on the plate-like holder 410 is adapted to mate with the gripping means 120 on the ESL 100. The receiving means 20 on the plate-like holder 410 can be a slot. The plate-like holder 410 can also be attached to an object, for example merchandise, or attached to, for example, a wall using fastening means. The ESL 100 may actually be directly attached to virtually anything, as long as receiving means 20 are provided. Thus, the ESL 100 may be attached directly onto a box (for example, a cardboard box), as long as the receiving means is formed onto the box.

In an alternative embodiment of the present invention, the ESL 100 and ESL holder 10, 400, 410 combination comprising a locking mechanism for releasably securing the ESL 100 to the ESL holder 10, 400, 410, has a mounting member that comprises a substantially flat ESL attachment surface. This could be a rail or a holder of any of the types disclosed herein. The ESL 100 has locking elements for securing it against the substantially flat mounting surface of the mounting member. The mounting member has receiving slots provided in the substantially flat ESL attachment surface for receiving the locking elements. Furthermore, the embodiments of the present invention may include a spring loaded element 125 that can be locked to a latch in a latched position thereby securing the locking element in a locked position, and a second fixed member having a hook-like shape insertable in a respective slot and enabling positioning of the fixed member in a hooked position from which it cannot be retracted when the locking element 160 is secured in its locked position.

A person skilled in the art will realize that the inverted solution, that is, letting the locking mechanism and/or the gripping means be part of the ESL holder 10, 400, 410, and letting the ESL 100 comprise the receiving means 20, may be considered to fall within the scope of the embodiments of the present invention.

While the embodiments of the present invention have been described in connection with what is presently considered to be the most practical and preferred embodiments, it is to be understood that the invention is not to be limited to the disclosed embodiments. On the contrary, it is intended to cover various modifications and equivalent arrangements within the scope of the claims.

The invention claimed is:

1. A combination Electronic Shelf Label (ESL) and ESL holder with a locking mechanism for releasably securing the ESL to the ESL holder, comprising:

at least one gripping means provided on the ESL for cooperative engagement with the ESL holder, wherein the gripping means comprises a hook-like shape suitable for securely grasping a receiving means;

a locking element integral with a movable locking plate in the ESL for cooperative engagement with the ESL holder;

at least one receiving means provided on the ESL holder for receiving the gripping means and the locking element in cooperative engagement;

a spring loaded element provided on the movable locking plate in the ESL, wherein the locking element and the gripping means are positioned such that the locking element and the gripping means are insertable in the receiving means on the ESL holder, wherein the locking element rests on an edge of the receiving means in the ESL holder when inserted, wherein the gripping means is displaceable into a hooked position, and such displacement causes the movable locking plate to move inside the ESL, wherein the spring loaded element on the movable locking plate secures the locking element in a locked position by grasping a latch and entering a latched position so as to prevent removal of the ESL from the ESL holder until the spring loaded element on the movable locking plate is forced against a spring force to leave the latched position, and wherein, when the movable locking plate is displaced from its latched position, the movable locking plate is permitted move back to an unlocked position, and this movement brings the locking element to an unlocked position when the gripping means is forced out of its hooked position, thus enabling removal of the ESL from the ESL holder.

2. The combination ESL and ESL holder according to claim 1, further comprising at least one receiving element adapted to receive at least one protruding element of the locking mechanism or ESL.

3. The combination ESL and ESL holder according to claim 2, wherein the ESL holder is a shelf edge rail that is longitudinally extended and adapted to receive the at least one protruding element of the locking mechanism or ESL.

4. The combination ESL and ESL holder according to claim 2, wherein the at least one receiving element is a protruding hook-like element adapted to receive the at least one protruding element of the locking mechanism or ESL.

5. The combination ESL and ESL holder according to claim 2, wherein the at least one receiving element is a recess that is adapted to receive the at least one protruding element of the locking mechanism or ESL.

6. The combination ESL and ESL holder according to claim 5, wherein the ESL holder is a shelf edge rail, and the recess is an elongated recess extending in a longitudinal direction of the rail, and the recess comprises a substantially "L"-shaped cross-section wherein a leg of the "L" extends substantially perpendicular to a surface of the shelf edge rail, and wherein a foot of the "L" extends substantially perpendicular to the leg of the "L" inside the shelf edge rail.

7. The combination ESL and ESL holder according to claim 1, wherein the ESL holder comprises a positioning element slot adapted to receive a positioning element to secure the ESL sideways in relation to the ESL holder.

8. A locking mechanism for releasably securing an ESL to an ESL holder in a combination ESL and ESL holder, comprising;

at least one gripping means provided on the ESL for cooperative engagement with at least one receiving means on the ESL holder;

at least one locking element integral with a movable locking plate in the ESL for cooperative engagement with the ESL holder;

a spring loaded element provided on the movable locking plate, wherein the locking element and the gripping means are arranged for cooperative engagement with the receiving means on the ESL holder, wherein the gripping means comprises a hook-shaped cross-section and is adapted to hook into the receiving means on the ESL holder, wherein the locking element is configured such that it is brought into a locked state in a recess on the ESL holder when the gripping means is positioned in a hooked position in the receiving means, wherein the spring loaded element cooperates with a latch on the ESL and enters a latched position, wherein the latch, when locking the spring loaded element, prevents the movable locking plate and the locking element to leave their locked position until the spring loaded element is forced to leave its latched position, which movement allows the movable locking plate and the locking element to leave their locked state.

9. The locking mechanism according to claim 8, further comprising a magnetic element attached to the spring loaded element.

10. The locking mechanism according to claim 9, wherein the spring loaded element further comprises a resilient member comprising at least one movable section, wherein the resilient member is attached to the movable locking plate, and wherein the magnetic element is placed on the at least one movable section of the resilient member.

11. The locking mechanism according to claim 10, wherein the resilient member is a resilient tongue comprising at least one free movable section, wherein the resilient tongue is attached to the movable locking plate, and wherein the magnetic element is attached to the at least one free movable section.

12. The locking mechanism according to claim 9, wherein the magnetic element forces the spring loaded element from its latched position to an unlatched position when exposed to a magnetic field, thus enabling movement of the locking element from its locked position to an unlocked position when the gripping means on the ESL is moved from its hooked position, making it possible to remove the ESL from the ESL holder.

13. The locking mechanism according to claim 8, wherein the locking mechanism is integral with the ESL.

14. The locking mechanism according to claim 8, further comprising a positioning element on the ESL to secure the ESL sideways in relation to the ESL holder.

15. The locking mechanism according to claim 14, wherein the positioning element and the locking element are the same element.

16. A combination ESL and ESL holder with a locking mechanism for releasably securing the ESL to the ESL holder, comprising:

a mounting member comprising a substantially flat ESL attachment surface;

a plurality of locking elements on the ESL for securing the ESL against the substantially flat ESL attachment surface of the mounting member, wherein the mounting member comprises receiving slots provided in the substantially flat ESL attachment surface for receiving the locking elements, and wherein the locking elements comprise a first member insertable in a first slot, and a second fixed member having a hook-like shape insertable in a second slot, where the locking elements enable positioning of the second fixed member in a hooked position from which it cannot be retracted.

* * * * *